United States Patent [19]

Cope

[11] Patent Number: 4,585,214

[45] Date of Patent: Apr. 29, 1986

[54] DECORATIVE RAILS AND METHOD FOR ASSEMBLING SAME

[75] Inventor: Carroll W. Cope, Marion, Va.

[73] Assignee: DG Shelter Corp., Marion, Va.

[21] Appl. No.: 668,297

[22] Filed: Nov. 5, 1984

[51] Int. Cl.[4] ..... E04H 17/14

[52] U.S. Cl. ..... 256/65; 403/282; 29/525

[58] Field of Search ..... 403/382, 298, 282; 256/65, 66; 29/525

[56] References Cited

U.S. PATENT DOCUMENTS

| | | | |
|---|---|---|---|
| 2,833,522 | 5/1958 | Michaels | 256/65 |
| 3,527,486 | 9/1970 | Gamp | 403/298 X |
| 3,955,799 | 5/1976 | Lauzier | 256/65 X |

*Primary Examiner*—Andrew V. Kundrat

*Attorney, Agent, or Firm*—Flehr, Hohbach, Test, Albritton & Herbert

[57] ABSTRACT

Decorative rail-like structures and methods for making the same wherein rails and rail supports are securely joined by the engagement of a rail channel with a rail support having a male projection with a ridge associated therewith. The male projection and associated ridge have a width greater than the width of the rail channel and are made from a material which is more resistant to compressive deformation than the material forming the rail channel. When inserted into the rail channel the ridge deforms a rail channel surface to form a depression complimentary to the ridge. The engagement of the ridge and depression resists the disengagement of rail and rail support.

4 Claims, 7 Drawing Figures

DECORATIVE RAILS AND METHOD FOR ASSEMBLING SAME

The present invention is directed to an improved rail-like structure and an improved method of assembling the same. More particularly, this invention is directed to an improved method of assembling decorative rails.

Examples of rail-like structures include rail fences, banisters, guard rails, hand rails, structural rails, decorative rails and the like. Rail-like structures have at least two basic components: a rail and a rail support. The rail is typically an elongated component which may be connected to one or more rail supports by a variety of means and methods.

Decorative rails are rail-like structures which are attached to cabinets, furniture or other structures for ornamental effect. Decorative rails typically comprise at least one ornamental rail connected to another ornamental rail or directly to another structure by a plurality of decorative rail supports. In a common method of construction, the decorative support has a round peg on each end which is inserted into predrilled holes spaced along a side of the ornamental rail. An appropriate adhesive is used to form a secure joint between the rail and rail support. This type of construction is relatively complex and time consuming since individual holes must be drilled in the rail and the adhesive must be allowed to dry to form a secure joint. In addition, such construction is restrictive in that the decorative support pieces can only be positioned in the predrilled holes.

Accordingly, an object of the present invention is to provide simple and quick methods of assembling rail-like structures.

A further object of the present invention is to provide methods for assembling rail-like structures wherein the rail supports may be positioned at any point along the rail.

A further object of the present invention is to provide rail-like structures with rails and rail supports joined securely together without the use of an adhesive.

Still further, an object of the present invention is to provide rail-like structures made from rail and rail supports which are easily fabricated for simple, quick and and secure assembly without the use of an adhesive.

The present invention is directed to an improved rail-like structure and methods for making the same. According to the present invention, the connection between rail and rail support comprises the engagement of a male projection attached to a surface of one of the components of the rail-like structure with a female cavity on the other component of the rail-like structure. The male projection has one or more ridges which together with the male projection are more resistant to compressive deformation than the surface of the female cavity which it engages. These ridges are oriented in such a way that when compressive force is applied to the junction of a male projection and a female cavity, the ridges on the male projection deform the female surface to form a partial or complete complimentary depression in the female surface. The orientation of the male ridge and female depression are such that the engagement of male ridge and female depression resists the disengagement of the rail and rail support. In addition, resistance to disengagement may also be the result of friction produced by the compressive force applied to the junction. The compressive force at the junction of the male projection and the female cavity, may be generated by engaging a female cavity with a male projection having one or more ridges which together have a dimension equal to or greater than the complimentary female dimension which engages the male projection and ridge.

Additional objects and features of the invention will be evident from the following description taken in conjunction with the following drawings wherein.

Figure 1:
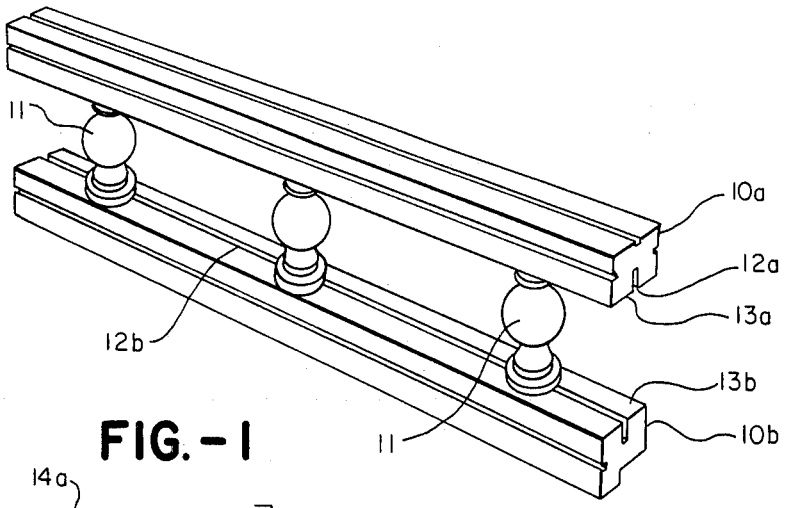
FIG. 1 is a perspective view of a rail-like structure made in accordance with the present invention.
Figure 2:
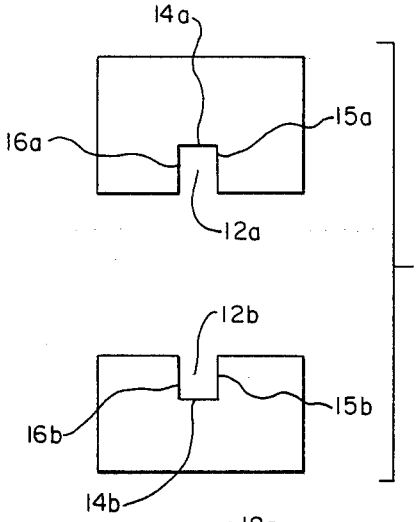
FIG. 2 is a cross-sectional view of two rail components used to construct a rail-like structure according to the present invention.

Referring now to the drawings, a preferred embodiment of the present invention is depicted in FIG. 1. A decorative rail-like structure may be assembled from two rails 10*a* and 10*b*, joined together by a plurality of decorative rail supports 11. Rails 10*a* and 10*b* are elongate and have rail channels 12*a* and 12*b* along the entire length of the opposed surfaces 13*a* and 13*b* of rails 10*a* and 10*b*. Rail channels 12*a* and 12*b* in FIG. 2 each have a base surface 14*a* and 14*b* and two opposite surfaces 15*a* and 16*a* and 15*b* and 16*b*, which define rail channels 12*a* and 12*b*. Rails 10*a* and 10*b* may be of uniform composition, such as wood or wood composite. Rail channel surfaces 14*a*, 14*b*, 15*a*, and 15*b* may be wood, wood composite, or other suitable structural material.

Figure 3A:
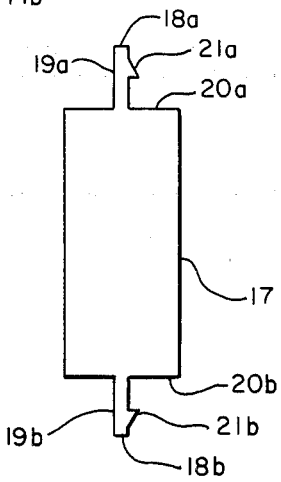
FIG. 3A and FIG. 3B are longitudinal cross-sections of a rail support of the present invention.
Figure 3B:
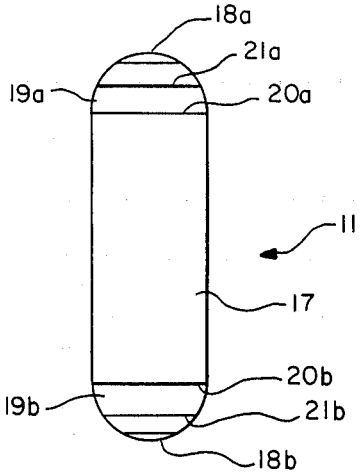

The rail supports 11 in FIG. 1 are depicted in greater detail in FIGS. 3*a* and 3*b*. The body 17 of rail support 11 is multi-functional: it is ornamental in design and structural in that it supports rails 10*a* and 10*b*. The rail channel engaging means 18*a* and 18*b* have planar tabs 19*a* and 19*b* projecting essentially perpendicular to surfaces 20*a* and 20*b* of body 17 and have ridges 21*a* and 21*b* associated therewith. In a preferred embodiment, rail support 11 which includes body 17 and rail engaging means 18*a* and 18*b*, may be made entirely from a plastic material. Ridges 21*a* and 21*b* and tabs 19*a* and 19*b* should be made from material which has a greater resistance to compressive deformation than the surface of channel 12*a* and 12*b* of FIG. 2 which will contact ridges 21*a* and 21*b*.

Figure 4:
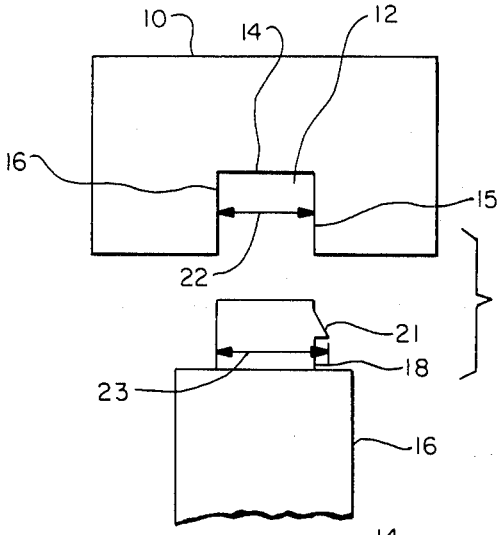
FIG. 4 is a partial cross-sectional view of a rail and rail support prior to engagement.

FIG. 4 depicts an isolated rail and rail support connection according to the present invention prior to engagement. A rail engaging means 18 with associated ridge 21 is shown together with rail 10 having rail channel 12 with a base surface 14 and rail channel opposing surfaces 15 and 16. The rail channel 12 has a width 22. The rail channel engaging means 18 together with ridge 21 has a width 23 in the dimension shown which is greater than width 22.

Figure 5:
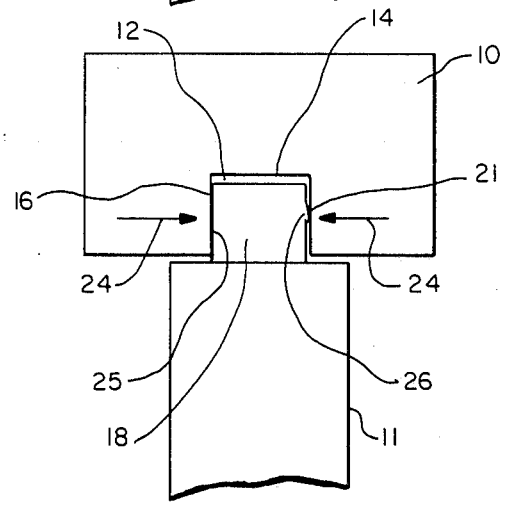
FIG. 5 is a partial cross-sectional view of a rail-like structure made in accordance with the present invention.

FIG. 5 depicts the structure of FIG. 4 after engagement of the rail engaging means 18 with the rail channel 12. Upon engagement of the rail channel 12 by the rail channel engaging means 18 with ridge 21, a compressive force 24 is generated due to the difference in channel width 22 and the width 23 which is greater than width 22. Compressive force 24, as depicted in FIG. 5 may be expected to generate frictional forces between rail channel surface 16 and the surface 25 of rail channel engaging means 18. Additional frictional forces would be expected between the point of contact 26 of ridge 21 and channel surface 15.

Figure 6:
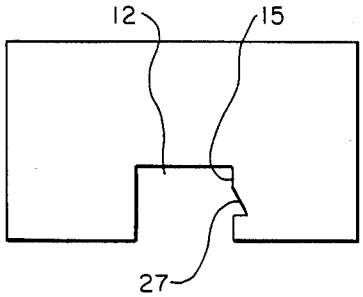
FIG. 6 is a cross-sectional view of a rail which depicts the rail after engagement by a rail support.

The connection of rail-like components in the present invention encompasses more than the friction resulting from the compressive forces generated by engaging a female cavity with an oversized male projection. In addition, the present invention contemplates that ridge 21 will form a depression 27 in channel surface 15 which is partially or completely complimentary to the shape of ridge 21. The depression 27 of channel surface 15 is depicted in FIG. 6. Engagement of ridge 21 with depression 27 resists the disengagement of rail 10 from rail support 11. To the extent that there is a residuum of compressive force 24, the resulting friction between the points of contact between rail channel 12 and rail engaging means 18 will also resist disengagement.

The invention is not limited to the use of wood rails and plastic rail supports. In practicing this invention, the materials used for the female cavity should be capable of being compressively deformed by the ridge on the male projection.

The female cavity is not limited to the rail channel disclosed in the preferred embodiment. Instead, such cavities may have a cross-section which is circular, triangular, square, rectangular or any other shape. Of course, the shape and size of the female cavity will control the size and shape of the male projection used to engage the female cavity.

Moreover, the invention is not limited to rail-like structures with rail supports perpendicular to the rail. Inclined rail-like structures are also contemplated by the present invention.

Having described the preferred embodiment of the present invention, it will occur to those ordinarily skilled in the art that various modifications may be made to the disclosed embodiment, and that such modifications are intended to be within the scope of the present invention.

What is claimed is:

1. A rail-like structure comprising at least one elongate rail with at least one inner-surfaced, deformable, rail channel defined longitudinally along a side thereof, said rail channel having a substantially constant width and essentially comprising a longitudinal base surface and two longitudinally opposite surfaces at least one of which is compressively deformed by at least one rail channel engaging means attached to a rail support, said means having a width greater than said width of said rail channel and comprising a tab and ridge which are substantially more resistant to compressive deformation than said compressively deformed channel surface.

2. A rail-like structure comprising at least one elongate rail with at least one rail support engaging means and at least one rail support having at least one rail engaging means which together comprise at least one planar-surfaced, deformable female cavity and at least one male projection each of which has an engagement surface parallel to an axis transverse to the longitudinal axis of said rail, where said engagement surface on said male projection has at least one ridge essentially normal to said transverse axis wherein said ridge contacts a compressively deformed ridge engaging depression on the engagement surface of said female cavity whereby said rail and rail support are securely joined.

3. A method of assembling a rail-like structure comprising;

inserting a plurality of channel engaging means into at least one planar-surfaced, deformable rail channel to form a rail-like structure comprising at least one rail and at least one rail support wherein said rail is elongate with at least one rail channel defined along a surface thereof, said rail channel essentially comprising a base surface and two opposing surfaces at least one of which may be compressively deformed, wherein the width of said rail channel is substantially constant, and said rail channel accommodates at least one channel engaging means comprising one or more tabs, each with at least one ridge having its longitudinal axis aligned such that it will be essentially parallel to the longitudinal axis of said rail channel when engaged, said channel engaging means being substantially resistant to compressive deformation relative to said compressively deformable rail channel surface wherein said channel engaging means has a width greater than said width of said rail channel, whereby said rail and rail support are joined by the contact between said ridge and a ridge engaging deformation formed in said compressively deformable rail channel surface by said ridge.

4. A method of assembling a rail-like structure comprising:

engaging a plurality of rail engaging means with at least one rail support engaging means to form a rail-like structure comprising at least one elongate rail and at least one rail support wherein said rail support engaging means and said rail engaging means together comprise at least one planar-surfaced, deformable, female cavity and at least one male projection each of which has an engagement surface parallel to an axis transverse to the longitudinal axis of said rail, where said engagement surface on said male projection has at lease one ridge essentially normal to said transverse axis, and said male projection and said ridge are more resistant to compressive deformation than said engagement surface of said female cavity and which together have a dimension greater than the corresponding dimension of said female cavity which accommodates said male projection whereby said rail and rail support are joined by the contact between said ridge and a ridge engaging deformation formed in said engagement surface of said female cavity by said ridge.

* * * * *